US011617993B2

(12) United States Patent
Hsu et al.

(10) Patent No.: US 11,617,993 B2
(45) Date of Patent: Apr. 4, 2023

(54) MATERIAL MIXING AND SUPPLYING SYSTEM

(71) Applicant: ASIA IC MIC-PROCESS, INC., Taipei (TW)

(72) Inventors: Hung-Hsin Hsu, Taipei (TW); Yan-Lan Chiou, Taipei (TW)

(73) Assignee: ASIA IC MIC-PROCESS, INC., Taipei (TW)

( * ) Notice: Subject to any disclaimer, the term of this patent is extended or adjusted under 35 U.S.C. 154(b) by 575 days.

(21) Appl. No.: 16/793,340

(22) Filed: Feb. 18, 2020

(65) Prior Publication Data

US 2020/0269200 A1 Aug. 27, 2020

(51) Int. Cl.

| | |
|---|---|
| ***B01F 3/12*** | (2006.01) |
| ***B01F 15/00*** | (2006.01) |
| ***B01F 15/02*** | (2006.01) |
| ***B01F 3/04*** | (2006.01) |
| ***B01F 23/50*** | (2022.01) |
| ***B01F 23/53*** | (2022.01) |
| ***B01F 23/232*** | (2022.01) |

(Continued)

(52) U.S. Cl.

CPC ..... *B01F 23/59* (2022.01); *B01F 23/232* (2022.01); *B01F 23/53* (2022.01); *B01F 35/187* (2022.01); *B01F 35/213* (2022.01); *B01F 35/22161* (2022.01); *B01F 35/22162* (2022.01); *B01F 35/71805* (2022.01); *B01F 23/23765* (2022.01); *B01F 2101/2204* (2022.01)

(58) Field of Classification Search

CPC ..... B01F 31/23; B01F 33/452; B01F 2101/2204; B01F 23/232; B01F 23/23765; B01F 23/53; B01F 23/59; B01F 33/812; B01F 35/187; B01F 35/213; B01F 35/22161; B01F 35/22162; B01F 35/71805

See application file for complete search history.

(56) References Cited

U.S. PATENT DOCUMENTS 6,413,154 B1 7/2002 Togawa et al.
8,322,911 B2 * 12/2012 Pich ..... B01F 25/85 241/62

(Continued)

FOREIGN PATENT DOCUMENTS

CN 1423307 A 6/2003
CN 1196759 C 4/2005

(Continued)

OTHER PUBLICATIONS

Google machine translation for "CN-106732127-A" (Year: 2017).*

*Primary Examiner* — Elizabeth Insler

(57) ABSTRACT

A material mixing and supplying system is provided. The material mixing and supplying system includes a feeding module, at least three mixing and supplying barrels, a supply module, and a control unit, wherein the three mixing and supplying barrels are capable of mixing and supplying the mixed material. The supplying time of the mixed material is greater than a sum of the feeding time and the mixing time. A total operation number of the at least three mixing and supplying barrels is determined by a set amount of mixed material to be supplied by the material mixing and supplying system, and a total time to finish supplying the set amount of mixed material is determined by the total operation number.

8 Claims, 9 Drawing Sheets

(51) Int. Cl.

| | |
|---|---|
| ***B01F 35/00*** | (2022.01) |
| ***B01F 35/213*** | (2022.01) |
| ***B01F 35/221*** | (2022.01) |
| ***B01F 35/71*** | (2022.01) |
| *B01F 23/237* | (2022.01) |
| *B01F 101/00* | (2022.01) |

(56) References Cited

U.S. PATENT DOCUMENTS

| | | | | |
|---|---|---|---|---|
| 2007/0092617 | A1* | 4/2007 | Burgos | B01F 23/43 426/519 |
| 2007/0109912 | A1* | 5/2007 | Urquhart | G05D 11/138 366/136 |
| 2010/0224256 | A1* | 9/2010 | Tseng | G01F 11/28 137/565.29 |

FOREIGN PATENT DOCUMENTS

| | | | | |
|---|---|---|---|---|
| CN | 106732127 | A | * | 5/2017 |
| JP | 2002016030 | A | | 1/2002 |
| JP | 2010089180 | A | | 4/2010 |
| TW | M526752 | U | | 8/2016 |

* cited by examiner

MATERIAL MIXING AND SUPPLYING SYSTEM

REFERENCE TO RELATED APPLICATIONS

This non-provisional application claims priority claim under 35 U.S.C. § 119(a) on Taiwan Patent Application No. 108105988 filed on Feb. 22, 2019, and the entire contents of which are incorporated herein by reference.

FIELD

The present disclosure relates to a material mixing and supplying system, more particularly, to a material mixing and supplying system with at least three mixing and supplying barrels.

BACKGROUND

In semiconductor wafer manufacturing process, the development went from the precision control of micro-processing to the micro/nano-processing which requires even more precision, and to ensure the stability and quality of chemical-mechanical polishing (CMP), it is important to grasp the slurry manufacturing process, which includes, starting from the feeding end, mixing, stirring, delivering, to dispatching to the factory end.

Conventional slurry, which is basically a compound, includes polishing material, acid-base indicator, pure water, and chemical additive. The polishing material includes micro particles with high-hardness like silicon oxide, aluminum oxide, and cerium oxide. The chemical additive usually includes suitable additives like potassium hydroxide, hydrogen peroxide, ferric nitrate, potassium iodate, and ammonia. The polishing material suspends in liquid, and by suitable additives and acid-base indicator, the interface therebetween is oxidized or activated and the pH value of the slurry is stabilized, respectively, to achieve an evenly polished effect.

In order to supply the evenly mixed slurry to the polishing machine, the conventional technology all use a mixing barrel for stirring the aforementioned materials and then transfer the evenly mixed slurry to a supplying barrel for supplying the slurry to the machine. The time needed for this process includes a feeding time for feeding the material to the mixing barrel, a mixing time for mixing the materials, a transfer time for transferring the mixed slurry to the supplying barrel, and a supplying time for supplying all the slurry required to the machine.

Due to limited space in the factory, many setups have been implemented to achieve the highest utility rate and stability in the limited space. Take the common dual-barrel setup as an example, a mixing barrel and a supplying barrel are utilized, and in this arrangement, each single barrel can have the largest capacity and the material quantity during each operation is the biggest. After the mixing barrel mixed the slurry, time is needed to transfer the slurry to the supplying barrel, and, at this time, the mixing barrel and the supplying barrel cannot perform other operations and the supplying barrel cannot be cleaned. Once the mixing barrel has a malfunction, the risk of terminating the slurry supply is high. In the situation where the two barrels both have mixing and supplying functions, the risk of terminating the slurry supply is lowered, however, when one of the two barrels broke down or needs cleaning and/or maintenance, although the other barrel continues to work, the supply will eventually be cutoff.

There are two common types of three-barrel setup, one is with two mixing barrels and one supplying barrel, and the other is with one mixing barrel and two supplying barrels, wherein the capacity of each single barrel is smaller than that of the two-barrel setup. The two barrels having the same function can provide functional redundancy when one cannot be used, but the other and the only barrel having a different function would be completely halted when it is unable to be used.

In another common four-barrel setup that uses two mixing barrels and two supplying barrels, the four barrels can provide functional redundancy for each other when one or two of the barrels have problems but the capacity of each barrel is even smaller, and in turn the number of machine operations would be far greater than the abovementioned arrangements.

Therefore, a new type of implementation setup is necessary for providing a continuous and stable supply of sufficient slurry and maintaining redundancies while the machine is being cleaned or repaired.

SUMMARY

To solve the aforementioned issues, the inventor improved the in-barrel slurry mixing process by changing the equipment used for delivering and mixing CMP slurry, and therefore provides an improved material mixing and supplying system that is implemented in a safe space and capable of providing better functional redundancy when mixing and supplying slurry or chemical. Moreover, the material mixing and supplying system of the present disclosure can perform the mixing more precisely and ensures the quality of the mixed material such as slurry or chemical at real time, and the system operation cost can also be reduced.

An object of the present disclosure is to provide a material mixing and supplying system that includes a feeding module, a supply module, at least three mixing and supplying barrels, and a control unit. The feeding module controls an input of raw material and the supply module supplies a mixed material to an external machine. The at least three mixing and supplying barrels are connected in parallel to one another and between the feeding module and the supply module, wherein each mixing and supplying barrel includes a mixing module for stirring and mixing the raw material to obtain the mixed material. The control unit is electrically connected to the feeding module, the mixing and supplying barrels and the supply module, wherein the control unit determines a feeding time, a mixing time, a supplying time, and a maintenance time of each mixing and supplying barrel to control a work sequence of the feeding module, the mixing and supplying barrels, and the supply module. The supplying time is greater than a sum of the feeding time and the mixing time. To obtain a starting time point of the feeding time for the mixing and supplying barrel that is spare among the three mixing and supplying barrels, an end time point of the supplying time of one of the three mixing and supplying barrels subtracts the sum of the feeding time and the mixing time. A total operation number of the at least three mixing and supplying barrels is determined by a set amount of mixed material that is to be supplied by the material mixing and supplying system, and a total time to complete the supplying of the set amount of mixed material is determined by the total operation number.

Preferably, each of the mixing and supplying barrels includes a cleaning module for cleaning the mixing and supplying barrel after the supplying time.

Preferably, each of the mixing and supplying barrels has a conical bottom with an angle of 60 to 120 degrees.

Preferably, the feeding module includes a plurality of control valves, wherein the number of control valves corresponds to the number of mixing and supplying barrels, and each control valve includes a plurality of valve blocks for controlling the input of different raw material.

Preferably, the material mixing and supplying system further includes a wet nitrogen device connected to the mixing and supplying barrels for providing nitrogen with atomized water to raise the humidity in the mixing and supplying barrels and to prevent drying and hardening of the mixed material.

Preferably, the material mixing and supplying system further includes an analysis module for analyzing a property of the mixed material and an adjustment module for adjusting a composition of the mixed material base on an analysis of the analysis module.

Preferably, the mixing and supplying barrels include a transfer pump set and a pressure-regulating and pulsation-absorbing module for regulating a supplying flow and a supplying pressure of the mixed material.

Preferably, each of the mixing and supplying barrels further includes an exhaust module for isolating and expelling exhaust to maintain the airtightness and pH in the mixing and supplying barrels.

Preferably, the exhaust module includes a filter module for controlling a property of the expelled exhaust.

Preferably, the material mixing and supplying system further includes a choke for blocking the mixing and supplying barrels from external contact and a nitrogen supply device for providing nitrogen to maintain a condition in the mixing and supplying barrels.

Preferably, the mixed material is slurry or chemical.

As stated above, the present disclosure provides a material mixing and supplying system having the following advantages:

(1) In the material mixing and supplying system of the present disclosure, the mixing and supplying barrels support and supplement for each other and so the high quality mixed material is stably provided and supplied without any/being cutoff.

(2) Through the analysis module, the mixed material in each barrel is instantly and constantly monitored and can be adjusted timely with the adjustment module.

(3) With proper pipeline arrangement and scheduling, the mixing and supplying barrels can work and supply alone or together to accommodate the needs.

BRIEF DESCRIPTION OF THE DRAWINGS

The structure as well as preferred modes of use, further objects, and advantages of this present disclosure will be best understood by referring to the following detailed description of some illustrative embodiments in conjunction with the accompanying drawings, in which.

DETAILED DESCRIPTION OF THE PREFERRED EMBODIMENTS

A material mixing and supplying system of the present disclosure will be described below with reference to the related figures, and for ease of understanding, the same elements in the following embodiment are marked the same.

Figure 1:
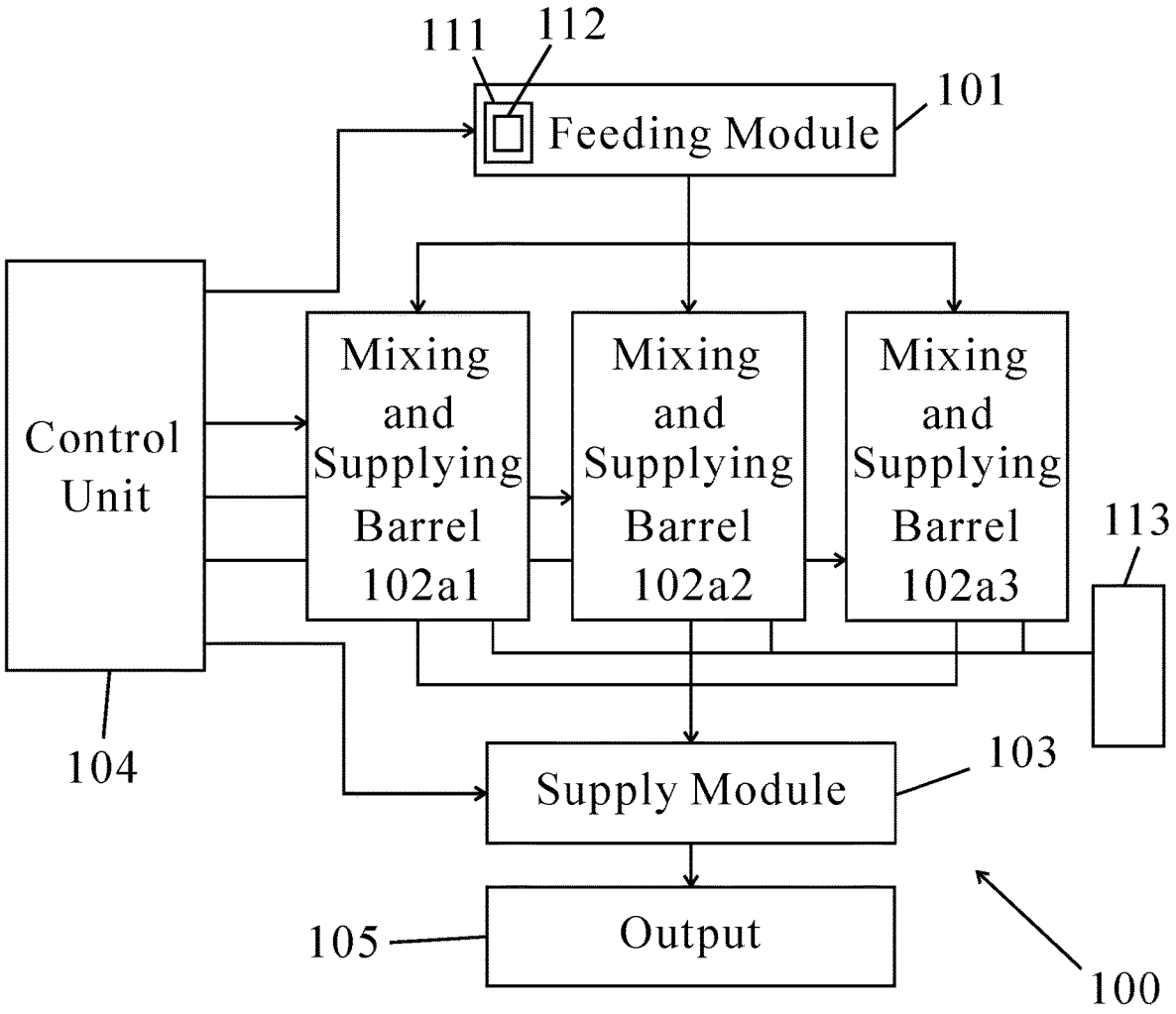
FIG. 1 is a block diagram of a material mixing and supplying system according to an embodiment of the present disclosure.
Figure 2:
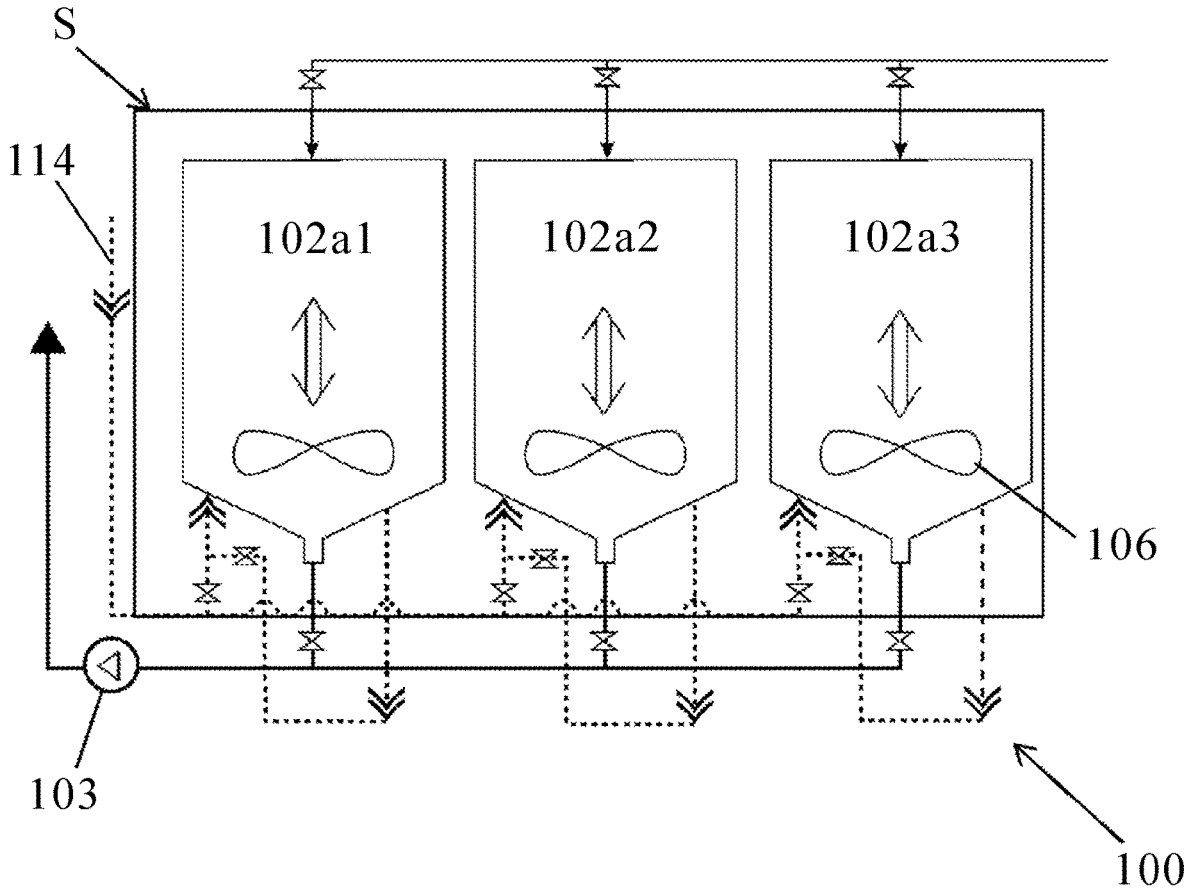
FIG. 2 is a schematic diagram illustrating a material mixing and supplying system setup in a predetermined space according to an embodiment of the present disclosure.

FIG. 1 and FIG. 2 are respectively a block diagram of a material mixing and supplying system and a schematic diagram of the material mixing and supplying system arranged in a predetermined space according to an embodiment of the present disclosure.

Figure 4:
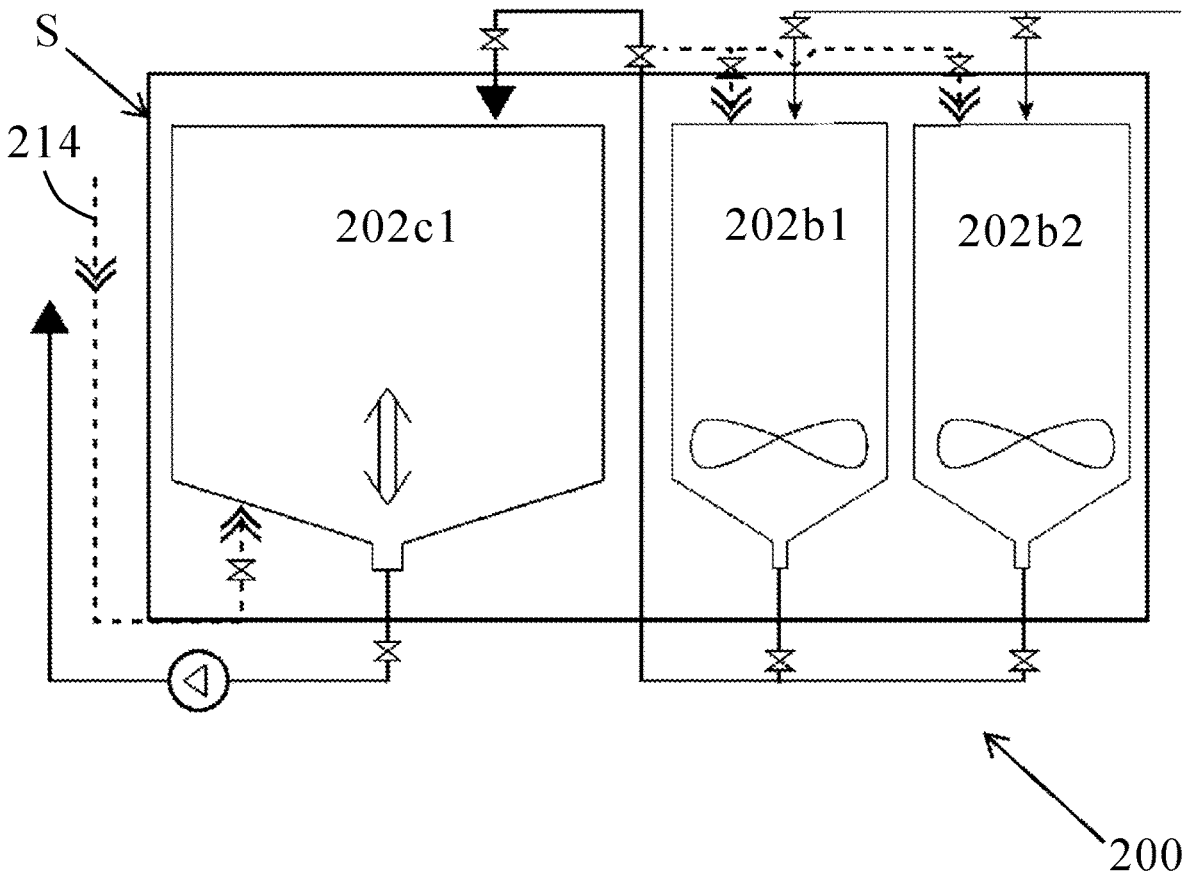
FIG. 4 is a schematic diagram of a first comparative system arranged in a predetermined space.
Figure 6:
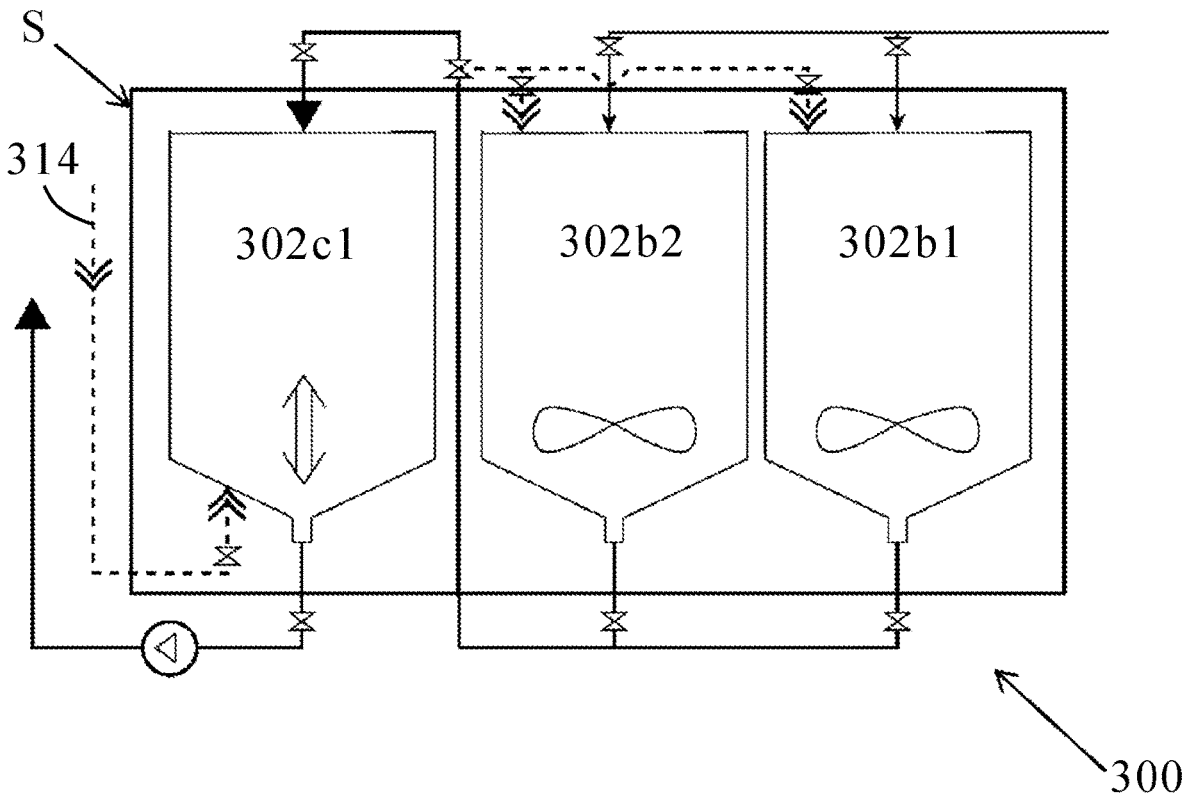
FIG. 6 is a schematic diagram of a second comparative system arranged in a predetermined space.
Figure 8:
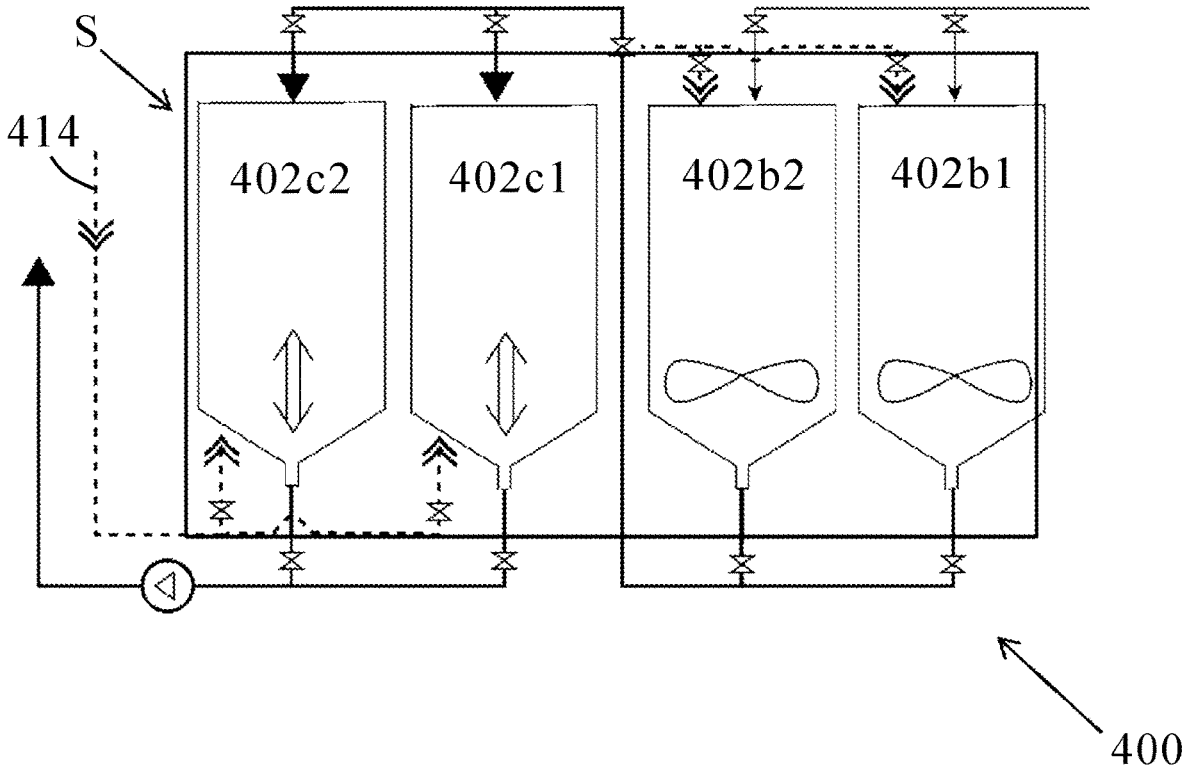
FIG. 8 is a schematic diagram of a third comparative system arranged in a predetermined space.

Referring to FIGS. 1 and 2, the material mixing and supplying system 100 includes a feeding module 101, three mixing and supplying barrels 102*a*1, 102*a*2, 102*a*3, a supply module 103, and a control unit 104. The feeding module 101 supplies all of the raw materials required to make a mixed material, wherein the mixed material can be slurry or chemical. Take making slurry as an example, the raw materials include polishing material with nanoparticles having high-hardness, such as silicon dioxide, aluminum oxide, and cerium oxide, and suitable additive like potassium hydroxide, hydrogen peroxide, ferric nitrate, potassium iodate, and ammonia. The present disclosure does not limit the composition of the raw materials and liquids. In addition, the material mixing and supplying system 100 includes return pipelines 114, which are showed as dotted process lines in FIG. 2. Similarly, the dotted process lines of FIG. 4 are return pipelines 214, the dotted process lines of FIG. 6 are return pipelines 314, and the dotted process lines of FIG. 8 are return pipelines 414.

The control unit 104 of the material mixing and supplying system 100 is electrically connected to the feeding module 101, the mixing and supplying barrels 102*a*1, 102*a*2, 102*a*3, and the supply module 103. The control unit 104 controls, with signals, an input of the feeding module 101, a stirring or mixing time of the mixing and supplying barrels 102*a*1, 102*a*2, 102*a*3, and a supply of a mixed material by the supply module 103 to an output 105. In specific, by determining a feeding time, a mixing time, a supplying time, and a maintenance time of each mixing and supplying barrel 102*a*1, 102*a*2, 102*a*3, the control unit 104 is able to control a work sequence of the feeding module 101, the mixing and supplying barrels 102*a*1, 102*a*2, 102*a*3, and the supply module 103 to keep the supplying of mixed material continuous and non-stop throughout the process.

The feeding module 101 includes one or a plurality of control valves 111, wherein the number of control valves 111 corresponds to the number of mixing and supplying barrels. Each control valve includes a plurality of valve blocks 112, wherein the number of valve blocks 112 may differ in corresponding to different raw materials. The valve blocks 112 may be of different sizes, wherein a large-size valve block reduces a feeding time, and a small-size valve block precisely adjusts the input.

According to the embodiment of the present disclosure, the three mixing and supplying barrels 102a1, 102a2, 102a3 are setup in a predetermined space S with the best space utility rate. These three mixing and supplying barrels 102a1, 102a2, 102a3 have the same structure and functions; the functions include capabilities to mix, supply and store. Therefore, the mixing and supplying barrels 102a1, 102a2, 102a3 can supplement each other functional-wise, in other words, they can provide functional redundancy in the material mixing and supplying system 100. Also, since the mixing and supplying barrels of the present disclosure have both the mixing function and the supplying function, the time for transferring the mixed material from a mixing barrel to a supplying barrel is saved. The mixing and supplying barrels 102a1, 102a2, 102a3 are designed to have a conical bottom with an angle between 60 to 120 degrees, such that the mixed material does not deposit at the bottom easily and so there is no residue when supplying the mixed material. Each of the mixing and supplying barrels 102a1, 102a2, 102a3 includes a mixing module 106 for stirring and mixing the raw materials such as slurry, DI water, H2O2 or chemicals fed into the barrel to obtain the mixed material. The mixing and supplying barrels 102a1, 102a2, 102a3 include a pressure-regulating and pulsation-absorbing module (not shown in drawings) and a transfer pump set (not shown in drawings), for regulating a supplying flow and a supplying pressure of the mixed material.

In addition, one or more heat exchange modules may be disposed between each mixing and supplying barrel 102a1, 102a2, 102a3 through proper pipeline arrangement to individually control the temperature of the liquid in the barrel. Each mixing and supplying barrel 102a1, 102a2, 102a3 also includes a cleaning module (not shown in drawings) with a 360-degree rotatable spray head for completely cleaning the inside of the barrel after the barrel has finished supplying the mixed material therein to prevent the next mixing from being affected by pipeline blockage or residue of the mixed material.

In order to timely monitor the status and/or a property of the mixed material in each mixing and supplying barrel 102a1, 102a2, 102a3, an analysis module (not shown in drawings) utilizing particle size analyzer like particle counter or zeta potential meter, viscometer, specific gravity meter, pH meter, and conductivity meter to measure the status/property of the mixed material in the barrel may be disposed. After the measurement and analysis, the trace composition in the mixed material may be adjusted by an adjustment module (not shown in drawings) or more raw materials may be added by the feeding module 101 by transmitting a signal to the control unit 104.

Each of the mixing and supplying barrels 102a1, 102a2, 102a3 may be connected to a wet nitrogen device 113. The wet nitrogen device 113 provides nitrogen having atomized pure water, wherein the wet nitrogen can reduce the metamorphism of the mixed material caused by the oxidation of the mixed material itself and, at the same time, can maintain the high humidity in the barrel through the vapor or water molecules, and thereby preventing the crystallization of the raw materials or the mixed material due to dryness, which would reduce the quality of the mixed material. Further, an exhaust module (not shown in drawings) may be disposed in each mixing and supplying barrel 102a1, 102a2, 102a3 for expelling the exhaust to maintain the pH in the mixing and supplying barrel. The exhaust module includes a filter module (not shown in drawings) that uses high efficiency particulate air filter (HEPA) to control the property and quality of the expelled exhaust to reduce air pollution in the environment.

Moreover, a pressure-regulating and pulsation-absorbing module may be disposed at places in each pipeline of the material mixing and supplying system 100 for modulating the pulsation and regulating the liquid flow and the pressure in the pipeline. In addition, the mixing and supplying barrels can be blocked from external contact by disposing a choke (not shown in drawings) in the predetermined space S. Further, the material mixing and supplying system 100 can include a nitrogen supply device (not shown in drawings) for providing nitrogen to maintain a condition in the mixing and supplying barrels.

Description of Work Sequence

In the following embodiments and comparative examples, each system is assumed to be implemented in the predetermined space S and the unit time t is 30 minutes, and the set conditions are as such: the predetermined space S is set to be a space that accommodates a total barrel volume of 300 liters (L), and for a volume of 1/12 S, the feeding time is 1 t, the mixing time is 0.5 t, the transfer time between barrels is 1 t, and the supplying time is 4 t.

It is to be noted that slurry will be used as the mixed material in the following descriptions for illustration purpose.

Supplying sequence for the material mixing and supplying system of the present disclosure Since the mixing and supplying barrels 102a1, 102a2, 102a3 used by the material mixing and supplying system 100 of the present disclosure have both the mixing function and the supplying function, the time for transferring mixed material/slurry from a mixing barrel to a supplying barrel is saved. The volume of the mixing and supplying barrel according to the embodiment of the present disclosure is 100 L (1/3 S), and therefore the feeding time is 4 t, the mixing time is 2 t, the supplying time is 16 t, and the cleaning or maintenance time is 24 t. The schedule illustrated in FIG. 3 is for supplying 5 barrels of finished product, in other words, the mixed slurry.

Figure 3:
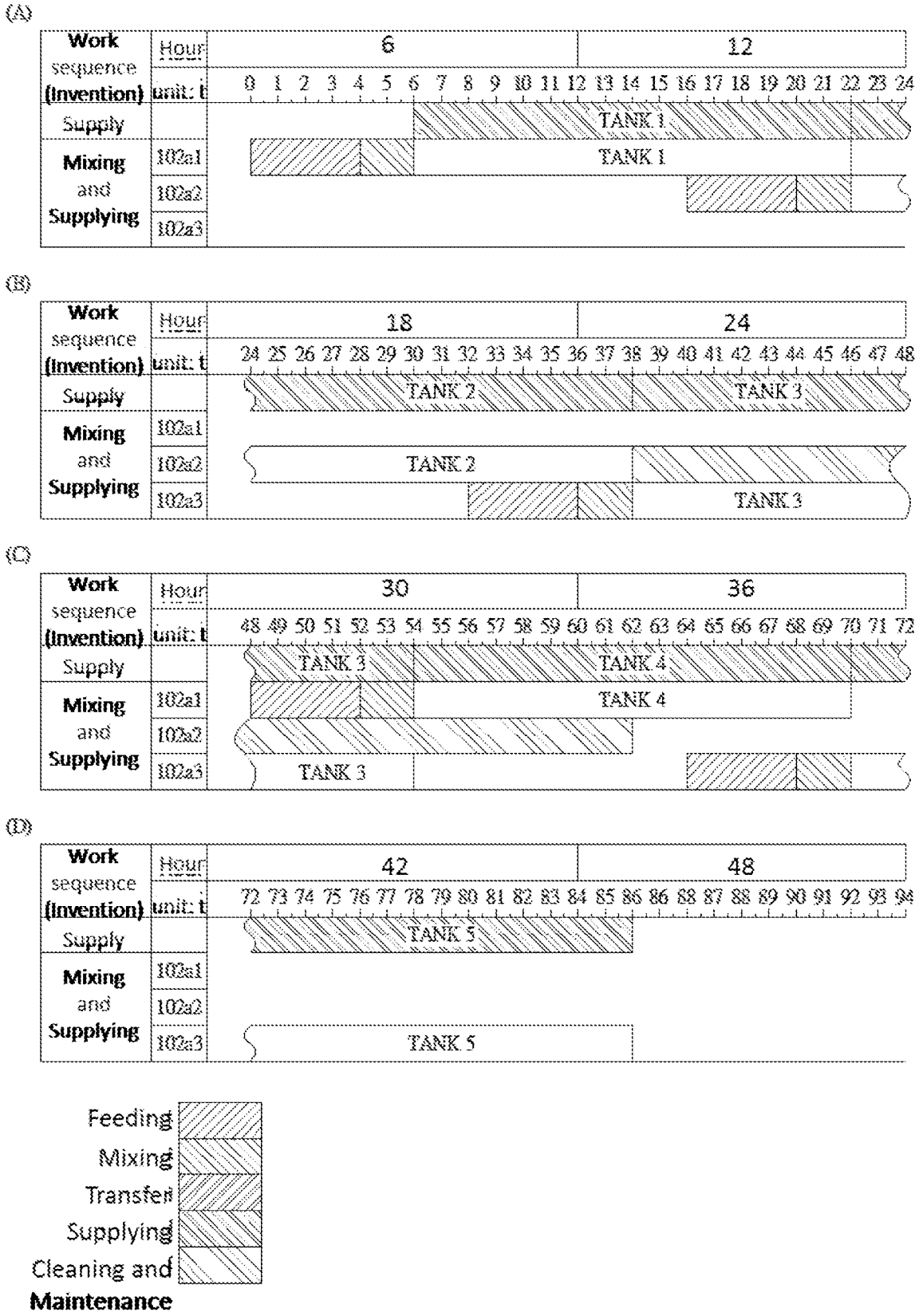
FIG. 3 is a schematic diagram illustrating a scheduling of a material mixing and supplying system according to an embodiment of the present disclosure.

Referring to part (A) of FIG. 3, the mixing and supplying barrel 102a1 starts working at 0 t on the schedule, wherein 0 t is the starting time point for inputting raw materials, and after the feeding time of 4 t, the 4 t on the schedule is the starting time point of the 2 t-mixing time for mixing the raw materials. Then at 6 t, the 16 t-supplying time begins and the supplying time ends at 22 t. To keep the supply of the slurry on-going without any interruption, the end time point of the mixing and supplying barrel 102a1 at 22 t is used to subtract the 4 t-feeding time and the 2 t-mixing time, which is 6 t in total, and the starting time point at 16 t for the mixing and supplying barrel 102a2 to begin receiving the input of raw materials is obtained. As shown in parts (A) to (C) of FIG. 3, even if the mixing and supplying barrel 102a2 begins its cleaning and maintenance operation at 38 t for a length of 24 t and continues to be unavailable for work until 62 t shown in part (C), the supply of the slurry would not be cutoff because the material mixing and supplying system 100 of the present disclosure includes three mixing and supplying barrels that are supplement to one another functional-wise and so when the mixing and supplying barrel 102a2 is undergoing the cleaning and maintenance operation, the mixing and supplying barrels 102a1 and 102a3 can still continue to supply the slurry. Hence, when one of the three mixing and supplying barrels is being cleaned and repaired, the other two mixing and supplying barrels can cooperate together to maintain the supply of the slurry.

Now, presume that a total operation number of each mixing and supplying barrel assembly is k, then the formula for a total time T needed to achieve the set amount of slurry is: T=16 kt+6 t, wherein the number of times the assembly needed to operate to supply the predetermined space S (300 L) is 3 (k=3), then the total time is 16*3 t+6 t=54 t.

Hence, the total operation number of all mixing and supplying barrels is determined by the set amount of mixed material to be supplied by the material mixing and supplying system. Moreover, the total time that the material mixing and supplying system takes to complete or finish supplying the set amount of mixed material is determined by the total operation number of all mixing and supplying barrels.

First comparative system: three-barrel setup with two mixing barrels and one supplying barrel FIG. 4 illustrates a first comparative system 200 setup in the predetermined space S. The first comparative system 200 includes two mixing barrels 202*b*1, 202*b*2 and one supplying barrel 202*c*1, wherein the amount of slurry that can be mixed by each mixing barrel 202*b*1, 202*b*2 at a time is half of the volume of the supplying barrel 202*c*1. In other words, the volume of each of the mixing barrels 202*b*1, 202*b*2 is 75 L (¼ S) and the volume of the supplying barrel 202*c*1 is 150 L (½ S). Similar to the embodiment of the present disclosure, in the first comparative system, the feeding time required for feeding raw materials to the mixing barrel is 3 t, the mixing time required for mixing the raw materials is 1.5 t, the supplying time for supplying all the slurry in the supplying barrel 202*c*1 is 24 t, the cleaning or maintenance time is 24 t, and the transfer time for transferring the mixed slurry in the mixing barrel is 3 t.

Figure 5:
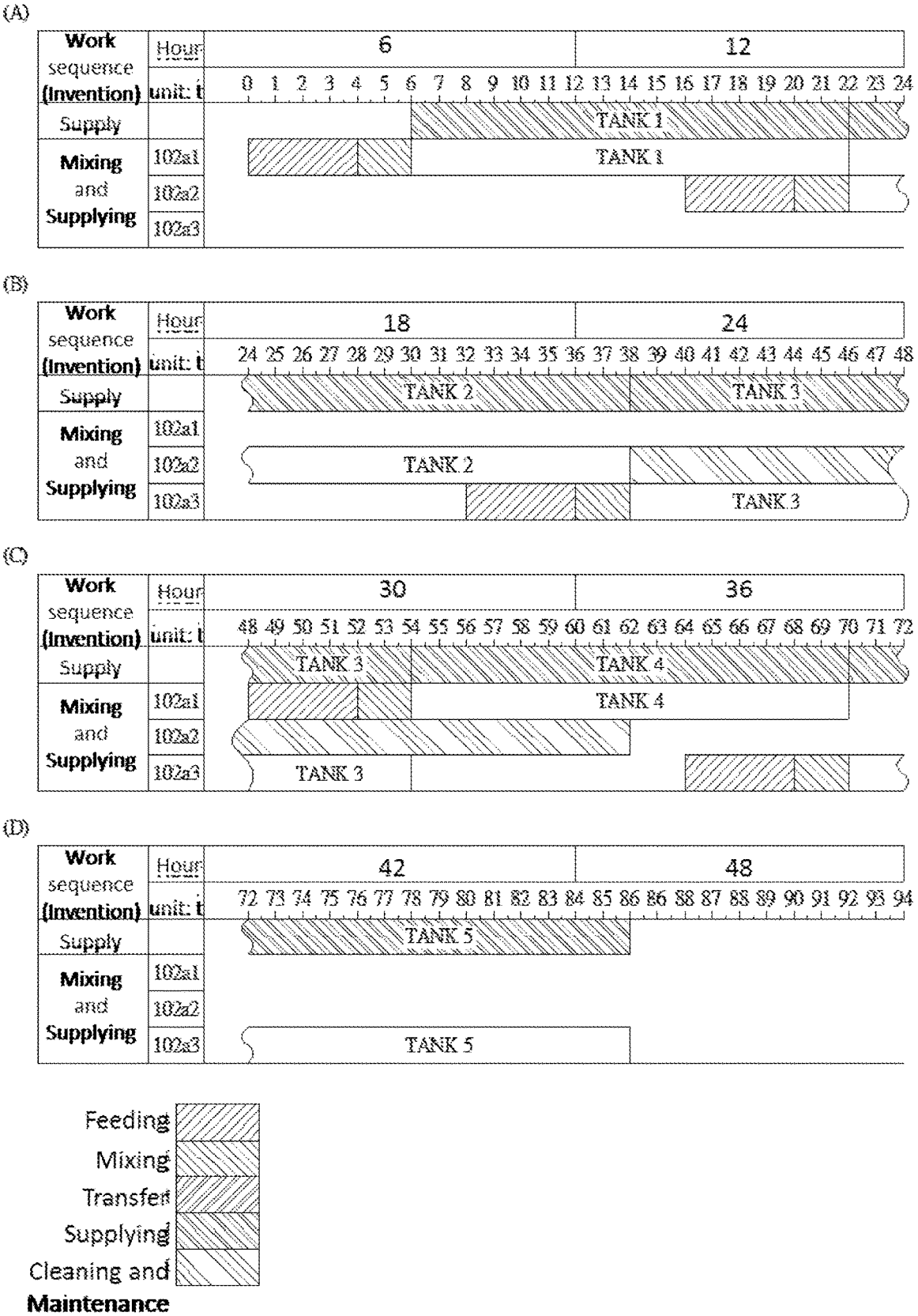
FIG. 5 is a schematic diagram illustrating a scheduling of the first comparative system.

Referring to FIG. 5, which is a work schedule of the first comparative system 200, it takes 7.5 t for the mixing barrel 202*b*1 to complete the feeding, mixing and transfer operations as shown in part (A) of FIG. 5, and the supplying barrel 202*c*1 begins supplying the slurry at 7.5 t. After feeding the mixing barrel 202*b*1, the feeding module immediately starts to feed the mixing barrel 202*b*2 at 3 t, and the mixing barrel 202*b*2 transfers the mixed slurry to the supplying barrel 202*c*1 at 7.5 t and then undergoes the cleaning and maintenance operation at 10.5 t. The mixing barrel 202*b*1 begins to receive feeding at a starting time point which is obtained by the end time point of the first complete supply at 31.5 t subtracting 7.5 t. The transfer amount should be sufficient for supplying up to 55.5 t while half of the supplying barrel 202*c*1 is being supplied at 12 t. Since the total time required for feeding, mixing and transfer is less than the supplying time, even if one of the mixing barrels in the first comparative system is broken or needs to be cleaned, the other mixing barrel can still provide sufficient slurry for the supply. When the cleaning or repairing of the mixing barrel 202*b*2 is done in part (B), the first comparative system returns to normal operation. However, once the supplying barrel 202*c*1 breaks down or requires cleaning, the supply of the slurry will be cutoff until the issues with the supplying barrel 202*c*1 are solved, and that is what we want to avoid.

In the first comparative system, presume that the operation number of the mixing barrel is i and the operation number of the supplying barrel is j, then the formula for a total time T needed to achieve the set amount of slurry is: T=24 jt+7.5 t, and 2 j=i; wherein the number of times the supplying barrel assembly needed to operate to supply the predetermined space S (300 L) is 2 (j=2), and the number of times the mixing barrel assembly operates is 4 (i=4). Thus, the total operation number of the mixing barrel assembly and the supplying barrel assembly is j+i=6, and the total time is 24*2 t+7.5 t=55.5 t.

Figure 7:
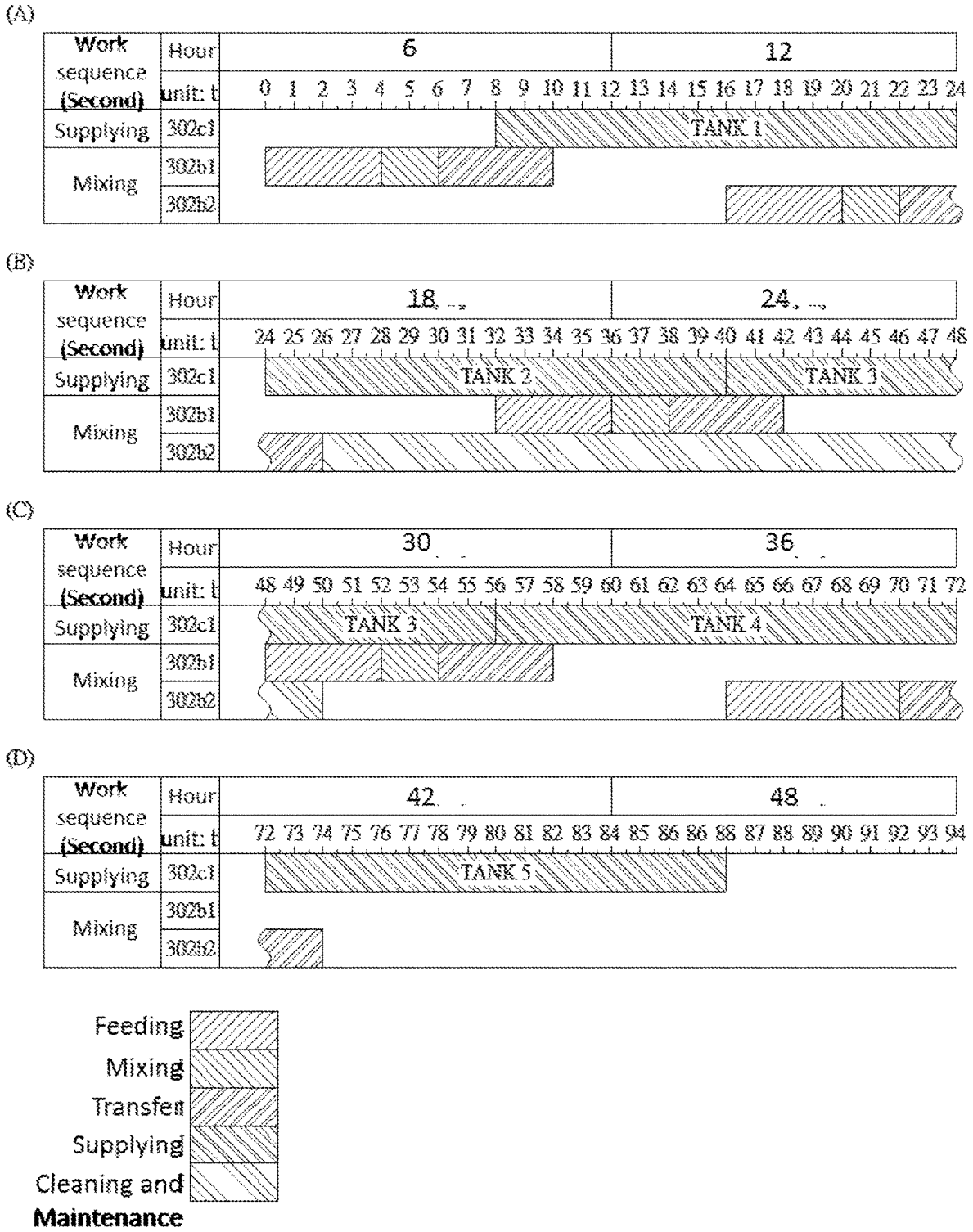
FIG. 7 is a schematic diagram illustrating a scheduling of the second comparative system.

Second comparative system: three-barrel setup with two mixing barrels and one supplying barrel FIG. 6 illustrates a second comparative system 300 setup in the predetermined space S. The second comparative system 300 includes two mixing barrels 302*b*1, 302*b*2 and one supplying barrel 302*c*1, wherein all three barrels 302*b*1, 302*b*2, 302*c*1 have the same volume, which means the volumes of the mixing barrels 302*b*1, 302*b*2 and the supplying barrel 302*c*1 are each 100 L (⅓ S). In this setup, the feeding time is 4 t, the mixing time is 2 t, the transfer time is 4 t, the supplying time for a complete supplying barrel is 16 t, and the cleaning or maintenance time is 24 t. The work schedule of the second comparative system is as shown in FIG. 7.

In the second comparative system, the supply of the slurry starts when the transfer of the slurry from the mixing barrel to the supplying barrel is half-way through, by which the system start time is moved up and the assembly usage is more frequent to increase efficiency. Referring to part (A) of FIG. 7, after the mixing is complete, the mixing barrel 302*b*1 starts to transfer the mixed slurry to the supplying barrel 302*c*1 at 6 t, and the supplying barrel 302*c*1 begins to supply the slurry at 8 t when the volume of the slurry transferred therein reached half of its barrel volume. The mixing barrel 302*b*2 then begins to receive feeding at 16 t and completes transfer at 26 t. At 26 t in part (B), the mixing barrel 302*b*2 undergoes the cleaning and maintenance operation, and since the time required for feeding, mixing and transfer is less than the supplying time, the second comparative system can also maintain the supply of the slurry when one of the mixing barrels is being cleaned or repaired. However, just the first comparative system, the supply of the slurry will be cutoff if the supplying barrel 302*c*1 needs cleaning or breaks down.

Presume that in the second comparative system, the operation number of the mixing barrel is i and the operation number of the supplying barrel is j, then the formula for a total time T needed to achieve the set amount of slurry is: T=16 jt+8 t, and j=i, wherein the number of times the supplying barrel assembly needed to operate to supply the predetermined space S (300 L) is 3 (j=3), and the number of times the mixing barrel assembly operates is 3 (i=3). Hence, the total operation number of the mixing barrel assembly and the supplying barrel assembly is j+i=6, and the total time is 16*3 t+8 t=56 t.

Figure 9:
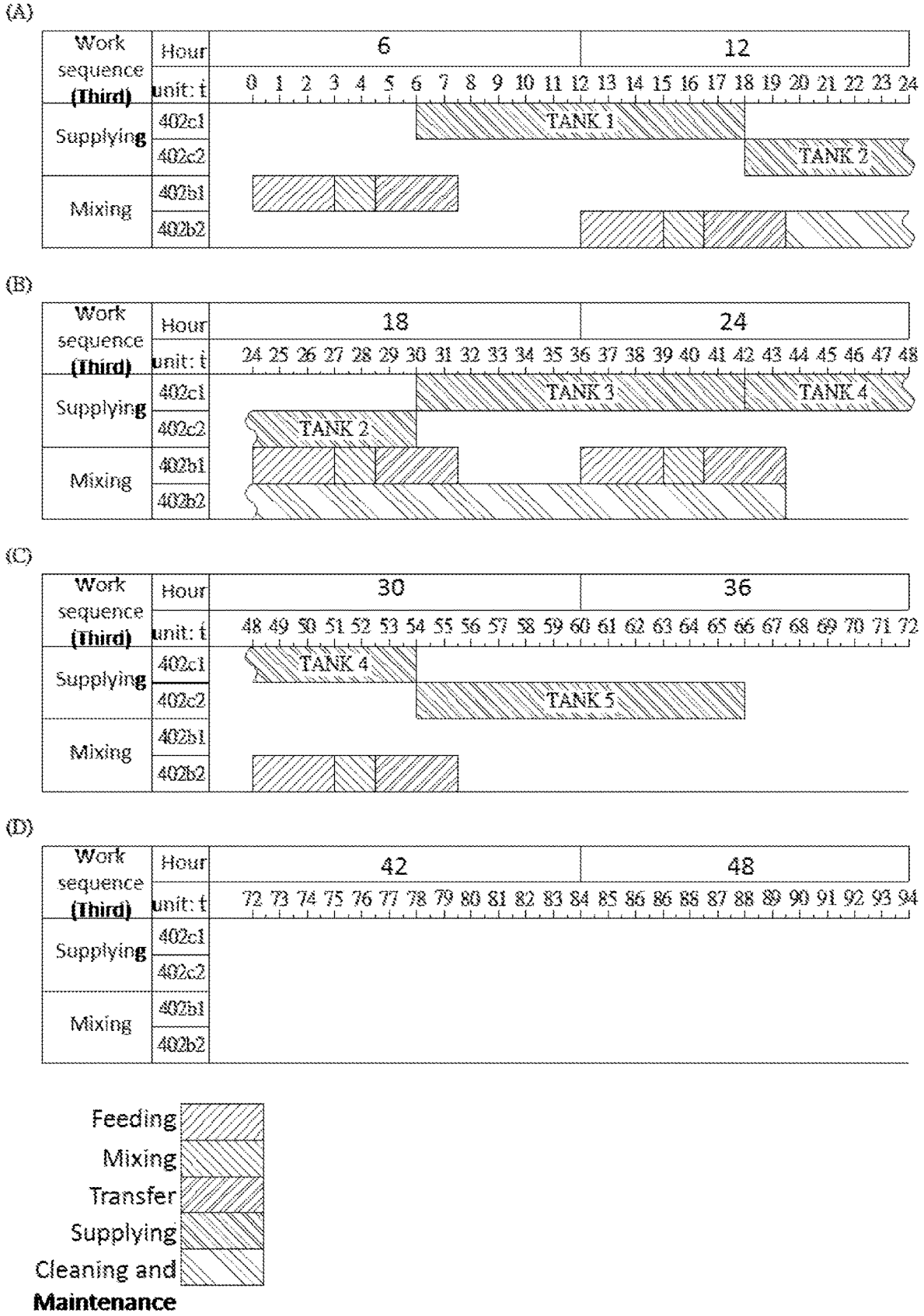
FIG. 9 is a schematic diagram illustrating a scheduling of the third comparative system.

Third comparative system: four-barrel setup with two mixing barrels and two supplying barrels FIG. 8 illustrates a third comparative system 400 setup in the predetermined space S. The third comparative system 400 includes two mixing barrels 402*b*1, 402*b*2 and two supplying barrels 402*c*1, 402*c*2, wherein all the barrels, mixing and supplying, have the same volume of 75 L (¼ S) per barrel. In this setup, the feeding time is 3 t, the mixing time is 1.5 t, the transfer time is 3 t, the time it takes to completely supply an entire supplying barrel is 12 t, and the cleaning or maintenance time is 24 t. The work schedule of the third comparative system is as shown in FIG. 9.

In the four-barrel setup of two mixing barrels and two supplying barrels, the supply of the slurry also starts when the transfer of the slurry from the mixing barrel to the supplying barrels is half-way through. As shown in part (A) of FIG. 9, the mixing barrel 402*b*1 completes the transfer of the slurry to the supplying barrel 402*c*1 at 7.5 t, but the supplying barrel 402*c*1 started supplying the slurry early at 6 t. The mixing barrel 402*b*2 then begins to receive feeding at 12 t and completes transferring the slurry to the supplying barrel 402*c*2 at 19.5 t, and the supplying barrel 402*c*2 starts supplying the slurry at 18 t. When the mixing barrel 402*b* undergoes the cleaning and maintenance operation at 19.5 t, for the next 24 t-timeframe, the mixing barrel 402*b*1 would mix the raw materials and transfer the mixed slurry to the supplying barrels 402*c*1, 402*c*2. If one of the supplying barrels 402*c*1, 402*c*2 undergoes the cleaning and maintenance operation, then the mixing barrels would alternately and continuously transfer the slurry to the working supplying barrel.

In the third comparative system, presume that the operation number of the mixing barrel is i and the operation number of the supplying barrel is j, then the formula for a total time T needed to achieve the set amount of slurry is: T=12 jt+6 t, and j=i, wherein the number of times the supplying barrel assembly needed to operate to supply the predetermined space S (300 L) is 4 (j=4), and the number of times the mixing barrel assembly operates is 4 (i=4). Therefore, the total operation number of the mixing barrel assembly and the supplying barrel assembly is j+i=8 and the total time is 12*4 t+6 t=54 t.

Although the four-barrel setup of two mixing barrels and two supplying barrels is relatively stable, where even if one of the mixing barrels and one of the supplying barrels undergoes the cleaning and maintenance operation, the supply of the slurry can still be kept continuous and ongoing, the smaller volume of each barrel would increase the operation number of each assembly. Table 1 below illustrates the number of times the assembly operates in different setups while providing the same amount of supply, wherein i is the operation number of the mixing barrel, j is the operation of the supplying barrel, and k is the operation number of the mixing and supplying barrel of the present disclosure.

TABLE 1

| Operation Number | Supply (L) | | | | | |
|---|---|---|---|---|---|---|
| (i + j) or k | 300 | 9000 | 18000 | 36000 | 108000 | 324000 |
| The Present Disclosure | 3 | 90 | 180 | 360 | 1080 | 3240 |
| First Comparative System | 6 | 180 | 360 | 720 | 2160 | 6480 |
| Second Comparative System | 6 | 180 | 360 | 720 | 2160 | 6480 |
| Third Comparative System | 8 | 240 | 480 | 960 | 2880 | 8640 |

From table 1, it can be seen that, when supplying the same amount of slurry/mixed material, the present disclosure has the lowest number of assembly operations, whereas the number of assembly operations in the three-barrel setups used by the first and the second comparative systems is twice of that of the present disclosure, and that number is even 2.67 times more than the present disclosure for the four-barrel setup used by the third comparative system.

Table 2 compares the supplying time of each setup to the amount of supply and it can be observed that because the supply rate is set to be fixed, the difference between the supplying time of each setup is less significant as the amount of supply increases.

TABLE 2

| Supplying | Supply (L) | | | | | |
|---|---|---|---|---|---|---|
| Time (unit: t) | 300 | 9000 | 18000 | 36000 | 72000 | 324000 |
| The Present Disclosure | 54 | 1446 | 2886 | 5766 | 11526 | 51846 |

TABLE 2-continued

| Supplying | Supply (L) | | | | | |
|---|---|---|---|---|---|---|
| Time (unit: t) | 300 | 9000 | 18000 | 36000 | 72000 | 324000 |
| First Comparative System | 55.5 | 1447.5 | 2887.5 | 5767.5 | 11527.5 | 51847.5 |
| Second Comparative System | 56 | 1448 | 2888 | 5768 | 11528 | 51848 |
| Third Comparative System | 54 | 1446 | 2886 | 5766 | 11526 | 81846 |

The material mixing and supplying system according to the embodiment of the present disclosure has the best setup in a limited space, and when each assembly needs cleaning or repair, the other assembly is able to supplement one another functional-wise and to provide functional redundancy, so that the supply of the mixed material is not cutoff. In addition, the number of operations by the assembly as a whole is reduced and in turn prolongs the lifecycle of the assemblies. Thus, the operation cost of the entire assembly is reduced, which increases a lifetime of the material mixing and supplying system. Furthermore, the reduced number of operations by the assembly as a whole and without transfer time between mixing and supplying barrels also reflects on a shortened total time to finish supplying a set amount of mixed material, and therefore the supplying efficiency is enhanced.

The above disclosure is only the preferred embodiment of the present disclosure, and not used for limiting the scope of the present disclosure. All equivalent variations and modifications on the basis of shapes, structures, features and spirits described in claims of the present disclosure should be included in the claims of the present disclosure.

What is claimed is:

1. A material mixing and supplying system, comprising:

a feeding module for controlling an input of raw material;

a supply module for supplying a mixed material to an external device;

at least three mixing and supplying barrels connected in parallel and between the feeding module and the supply module, wherein each of the mixing and supplying barrels comprises a mixing module for stirring and mixing the raw material to obtain the mixed material; and a control unit electrically connected to the feeding module, the mixing and supplying barrels, and the supply module, wherein the control unit determines a feeding time, a mixing time, a supplying time, and a maintenance time of each of the mixing and supplying barrels to control a work sequence of the feeding module, the mixing and supplying barrels, and the supply module;

wherein the supplying time is greater than a sum of the feeding time and the mixing time; and wherein a starting time point of the feeding time for the mixing and supplying barrel that is spare among the three mixing and supplying barrels is obtained by subtracting the sum of the feeding time and the mixing time from an end time point of the supplying time of one of the three mixing and supplying barrels;

wherein a set amount of mixed material to be supplied by the material mixing and supplying system determines a total operation number of the at least three mixing and supplying barrels and the total operation number of the at least three mixing and supplying barrels determines a total time to supply the set amount of mixed material.

2. The material mixing and supplying system of claim 1, wherein each of the mixing and supplying barrels comprises a cleaning module for cleaning the mixing and supplying barrel after the supplying time.

3. The material mixing and supplying system of claim 1, wherein each of the mixing and supplying barrels comprises a conical bottom with an angle of 60 to 120 degrees.

4. The material mixing and supplying system of claim 1, wherein the feeding module comprises a plurality of control valves, and the number of control valves corresponds to the number of the mixing and supplying barrels, wherein each of the control valves comprises a plurality of valve blocks for controlling the input of different raw material.

5. The material mixing and supplying system of claim 1, further comprising a wet nitrogen device connected to the mixing and supplying barrels for providing nitrogen with atomized water to raise a humidity in the mixing and supplying barrels and to prevent the mixed material from drying and hardening.

6. The material mixing and supplying system of claim 1, wherein each of the mixing and supplying barrels further comprises an exhaust module for isolating and expelling exhaust to maintain the airtightness and pH in the mixing and supplying barrels.

7. The material mixing and supplying system of claim 6, wherein the exhaust module comprises a filter module for controlling a property of the expelled exhaust.

8. The material mixing and supplying system of claim 1, wherein the mixed material is slurry or chemical.

* * * * *